US007493938B2

(12) United States Patent
Majarais et al.

(10) Patent No.: US 7,493,938 B2
(45) Date of Patent: Feb. 24, 2009

(54) COLLECTION SYSTEM FOR THE MECHANICAL CLEANING OF HEAT EXCHANGER TUBES

(75) Inventors: Bernard A. Majarais, Brampton (CA); Norman Korell, Oakville (CA); Frank Kamler, Milton (CA); Narinder Bains, Mississauga (CA); David Scott, Mississauga (CA)

(73) Assignee: Atomic Energy of Canada Limited/ Energie Atomique du Canada Limitee, Ontario (CA)

( * ) Notice: Subject to any disclaimer, the term of this patent is extended or adjusted under 35 U.S.C. 154(b) by 623 days.

(21) Appl. No.: 10/891,061

(22) Filed: Jul. 15, 2004

(65) Prior Publication Data

US 2005/0121174 A1 Jun. 9, 2005

Related U.S. Application Data

(60) Provisional application No. 60/487,236, filed on Jul. 16, 2003.

(51) Int. Cl.
*B08B 9/027* (2006.01)

(52) U.S. Cl. ..... 165/95; 134/22.01

(58) Field of Classification Search ..... 165/95; 15/300.1–304; 134/21, 22.11, 166 C
See application file for complete search history.

(56) References Cited

U.S. PATENT DOCUMENTS 2,455,514 A * 12/1948 Mead ..... 451/2
3,778,938 A * 12/1973 Korn et al. ..... 451/39
4,424,769 A 1/1984 Charamathieu et al.
4,492,186 A * 1/1985 Helm ..... 122/382
4,595,419 A * 6/1986 Patenaude ..... 134/1
4,610,838 A 9/1986 Gasparro et al.
4,632,068 A * 12/1986 Appleman et al. ..... 122/34
4,645,542 A 2/1987 Scharton et al.
4,653,578 A 3/1987 Horning
4,655,846 A 4/1987 Scharton et al.
4,670,062 A 6/1987 Lester
4,699,665 A * 10/1987 Scharton et al. ..... 134/1
4,773,357 A * 9/1988 Scharton et al. ..... 122/382
4,820,496 A 4/1989 Sapoff
4,905,900 A * 3/1990 Scharton et al. ..... 239/99
4,976,278 A * 12/1990 Ripley et al. ..... 137/15.16
5,017,329 A 5/1991 Vermant
5,069,172 A 12/1991 Shirey et al.
6,308,774 B1 * 10/2001 Kramer et al. ..... 165/95

FOREIGN PATENT DOCUMENTS

CA 2280348 11/1999

* cited by examiner

*Primary Examiner*—Allen J Flanigan
(74) *Attorney, Agent, or Firm*—Sughrue Mion, PLLC

(57) ABSTRACT

An apparatus for cleaning heat exchanger tubes and in particular an improved collection system for nuclear generator cleaning and blasting media and deposit material. A suction line having a downwardly directed suction inlet is effective to vacuum airborne media and debris in said chamber and vacuum media and debris deposited on the bottom of said chamber below said suction inlet. A hopper, air jet and shaker means are provided to transport deposited media and debris toward the suction inlet. Breaker and partition means are provided to reduce back-streaming of debris into heat exchanger tubes.

55 Claims, 5 Drawing Sheets

COLLECTION SYSTEM FOR THE MECHANICAL CLEANING OF HEAT EXCHANGER TUBES

This application claims benefit of Provisional Application No. 60/487,236 filed Jul. 16, 2003; the disclosure of which is incorporated herein by reference.

FIELD OF THE INVENTION

This invention relates to an apparatus for cleaning heat exchanger tubes and in particular to an improved collection system for nuclear steam generator cleaning and blasting media and deposit material.

BACKGROUND OF THE INVENTION

Magnetite corrosion products from carbon steel components in the primary heat transport system deposit on the walls of the steam generator tubes in nuclear power plants during operation. The function of the steam generator is to produce steam to turn turbines that generate electricity. Deposits on the walls of the steam generator tubes have a deleterious effect on heat transfer and flow, reducing steam generator performance. As the solubility of iron decreases with temperature, magnetite build-up is generally highest in the cold leg side of the tubes due to lower temperatures in that region. If the magnetite deposits are not removed they will eventually lead to the units being derated.

One known method for removing magnetite deposits from steam generator tubes uses a process akin to sandblasting for removing rust from metal surfaces. Stainless steel spheres of about 100 to 300 μm in diameter are employed as the blasting media. A manipulator system is placed on the cold leg side in the steam generator bowl (also referred to as the primary header or boiler cavity). The manipulator has a blasting head that attaches to one or two of the tube openings and the blasting media is forced through the tubes by compressed air. Blasting media and released magnetite deposits are collected by a second manipulator system on the hot leg side of the primary header. This second manipulator system has a collection head mated to the tube(s) being blasted from the cold leg side. While this system is effective in sealing to the tubes and preventing deposits and blasting media from being released and contaminating the equipment, it is relatively complicated, time consuming and required constant skilled operator attention and precise indexing of the collector head to the tube(s) being cleaned.

Another known method of collecting deposits and media is disclosed in U.S. Pat. No. 6,308,774 which issued to Siemens Aktiengesellschaft on Oct. 30, 2001. This patent discloses a method of cleaning heat exchanger tubes and a collection device for the collection of deposits from heat exchanger tubes. A funnel-shaped collecting vessel that is capable of being folded, rolled or collapsed is introduced through a service orifice or manway opening (usually approximately 18"×14") into the steam generator cavity and then unfolded, unrolled or opened such that its inlet orifice covers essentially all of the tube ends in the hot leg area of the heat exchanger tubesheet. The collecting vessel, called a "suction header" has an inflatable hose around the inlet orifice which when inflated, expands the inlet orifice to conform to the geometry of the area to be sealed. The system disclosed also includes a device for shaking the suction header to facilitate the removal of waste and debris. The system disclosed in U.S. Pat. No. 6,308,774 has a number of disadvantages.

Firstly, the sealing between the suction header and the heat exchanger tubesheet is inadequate, particularly for minute particles such a magnetite, and unacceptable levels of contamination have been experienced in the field.

In addition, the design of the suction header is such that due to the high velocity of the cleaning media, the very fine magnetite debris is redirected by the suction header and end up passing back through the tubes to the blasting side, thereby contaminating the cleaned tubes and the blasting equipment on the cold leg side of the primary header. Not only is the manipulator exposed to contamination, the minute magnetite particles can escape the boiler cavity, contaminating the immediate environment around the steam generator.

Magnetite particles and grit containing moisture can flock and adhere to the suction header wall. If a large buildup occurs, the flexible suction header can sag due to the weight of the debris, which can compromise the seal between the suction header and the heat exchanger tubesheet. In addition, the suction point can easily become clogged because it is upward facing. This may necessitate the removal and replacement of the suction header, potentially exposing workers to an unnecessary radiation dose. Accordingly, to prevent its occurrence, personnel are required to periodically physically shake the debris from the suction header by inserting their hands into the manway.

The suction header is also difficult to install. To effectively cover all of the tubes in the steam generator and also be able to withstand the high blast force and abrasion of the jet emerging from the tubes, the suction header has to have considerable mechanical strength and is typically manufactured of a relatively heavy thick-walled elastomeric material and takes two strong workers to install. Because it is just slightly smaller that the manway opening, it requires training and skill to insert into the manway and install inside the steam generator. Once installed, adjustments are required to ensure that the peripheral opening of the suction header seals properly to the edge of the tubesheet.

Accordingly, there remains a need for an improved collection system for steam generator cleaning of blasting media and deposit material which overcomes the problems of known systems.

SUMMARY OF THE INVENTION

Thus, in accordance with the present invention, there is provided, in a heat exchanger having a plurality of heat exchanger tubes, the ends of which are received in a tubesheet disposed at the upper end of a bowl shaped chamber, said chamber having an access opening therein, a system for collecting blasting media and deposit debris exiting from said tubes into said chamber comprising, a suction source, a suction line from said source passing through said access opening into said chamber, means for sealing said access opening about said suction line, said suction inlet effective to vacuum media and debris deposited at the bottom of said chamber.

In accordance with another embodiment of the present invention, a removable liner is disposed over the inside surface of said bowl shaped chamber for receiving deposited media and debris.

In accordance with another embodiment of the present invention, a partition wall(s) is provided for subdividing said chamber to confine airborne media exiting a heat exchanger tube opening on one side of the partition from entering a heat exchanger tube opening on the other side of said partition wall.

In accordance with another embodiment of the present invention, at least one breaker is disposed across said chamber intermediate said tubesheet and the bottom of said chamber for dissipating the energy of media and debris exiting said heat exchanger tubes.

In accordance with another embodiment of the present invention, a hopper is provided having a downwardly and inwardly sloped peripheral wall, an upper opening at the top edge of said wall disposed below said tubesheet and a lower opening at the bottom edge of said wall about said suction inlet, said hopper being effective for receiving media and debris exiting said heat exchanger tubes and for directing said received media and debris to said suction inlet.

In accordance with another embodiment of the present invention, one or more shaking devices are provided for imparting vibratory or shaking motion to said hopper and/or said suction inlet.

In accordance with another embodiment of the present invention, one or more air jets are provided for directing a blast of compressed air towards said access opening cover, and/or along the peripheral wall of said hopper towards said lower opening.

Further novel features and other objects of the invention will become apparent from the following detailed description, discussion and the appended claims read in conjunction with the drawings.

DETAILED DESCRIPTION OF THE PREFERRED EMBODIMENTS

Figure 1A:
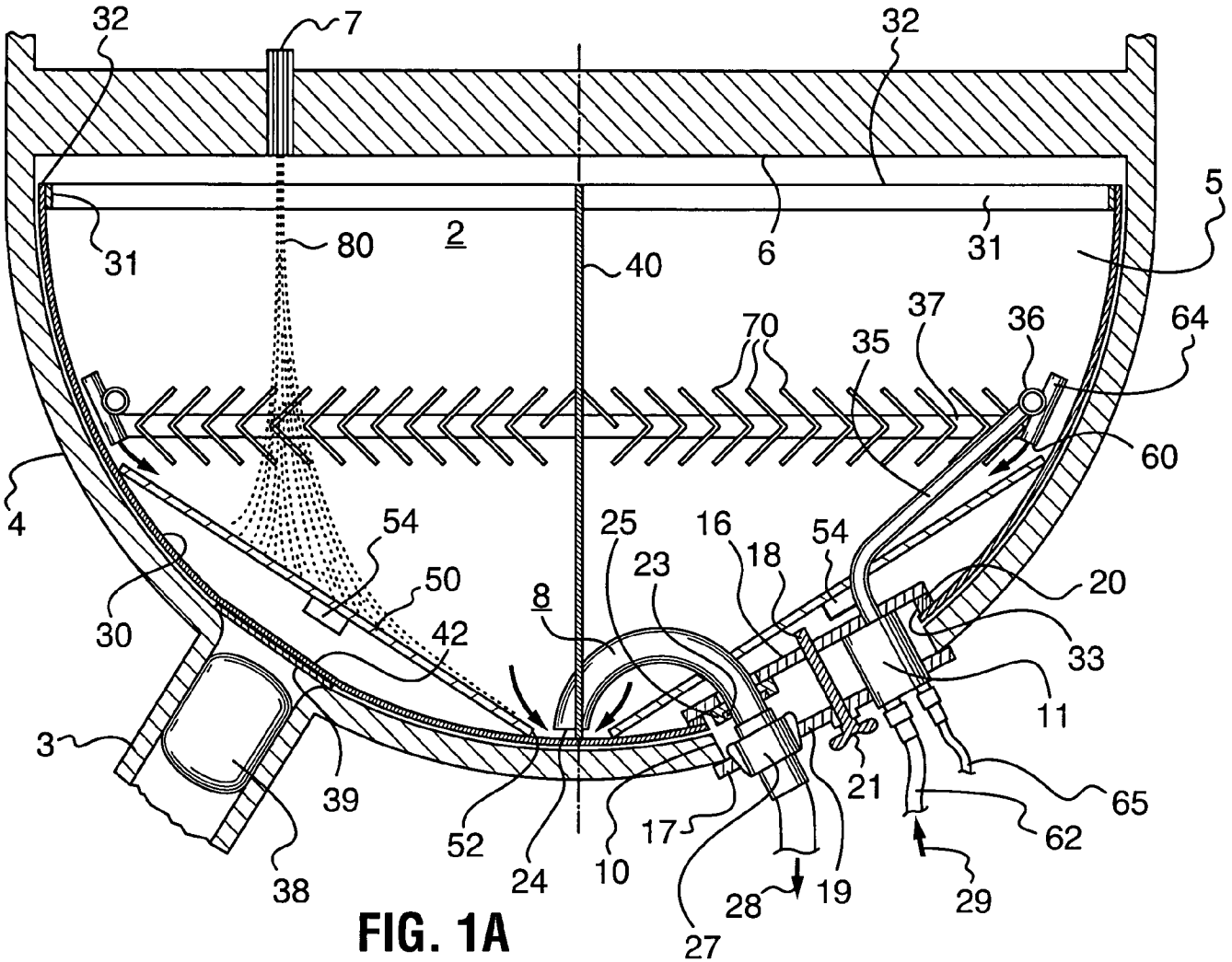
FIG. 1A is a sectional view of the hot leg side of a steam generator boiler cavity showing the collection system of the present invention.

Referring to FIG. 1, there is shown the hot leg side of boiler cavity 2 of a steam generator enclosure. Although the invention is described with reference to the hot leg side, it will be understood by a person skilled in the art that the invention can equally be applied to the cold leg side of the boiler cavity of a steam generator enclosure. Boiler cavity 2 is formed of primary bowl 4 which forms a chamber that is bounded at its upper end by tubesheet 6 into which are secured the openings of steam generator tubes 7 (only three of which are shown). Divider plate 5 separates cavity 2 into the hot and cold legs. Primary nozzle 3 communicated through primary bowl 4 into boiler cavity 2. Manway 10 is formed in primary bowl 4 to permit access to boiler cavity 2.

Manway 10 is sealed by manway cover 16. Manway cover 16 is secured in place by bracket 17 and shaft 18. Bracket 17 bridges the outer edges of manway 10 and threaded shaft 18 passes through bore 19 in bracket 17 and is threaded into cover 16. Resilient sealing gasket 20 is disposed about the periphery of cover plate 16. Manual turning of handle 21 threads shaft 18 into cover plate 16 draws cover plate 16 and gasket 20 into airtight sealing engagement with primary bowl 4 about manway 10.

The collection system of the present invention is comprised of suction line 8 that extends into boiler cavity 2 through manway 10. Suction line 8 is curved to form an inverted downwardly facing suction inlet 24 which is positioned in close proximity to the bottom of boiler cavity 2. Although a downward facing suction inlet is preferred, as it is most naturally formed by a suction line that extends downwardly from the manway toward the flat bottom of boiler cavity 2, an upward facing suction inlet can also be employed in the present invention. Suction line 8 utilizes coupling 27 to connect to vacuum source 28 such as an air ejector or a positive displacement blower (not shown). Suction line 8 is formed of rigid material to withstand the collapsing forces of the suction, and can be made from rigid pipe of about 2 to 3"inside diameter, although a semi-rigid plastic vacuum hose can also be employed.

Suction line 8 passes through an opening in manway cover 16. Collar 25 is provided about the opening for suction line 8 and can be tightened to clamp down onto the body of suction line 8 to secure it and cover 16 together. It is desirable to clamp the two together securely because the suction line is relatively heavy and inflexible and to prevent it from shifting position. Collar 25 should be sufficiently flexible to permit some adjustability in orientation of suction line 8 to adjust for steam generator and equipment tolerances. Sealing gasket 23, which can be made of soft closed cell foam rubber, is provided around the opening to prevent leakage through cover 16.

Figure 2A:
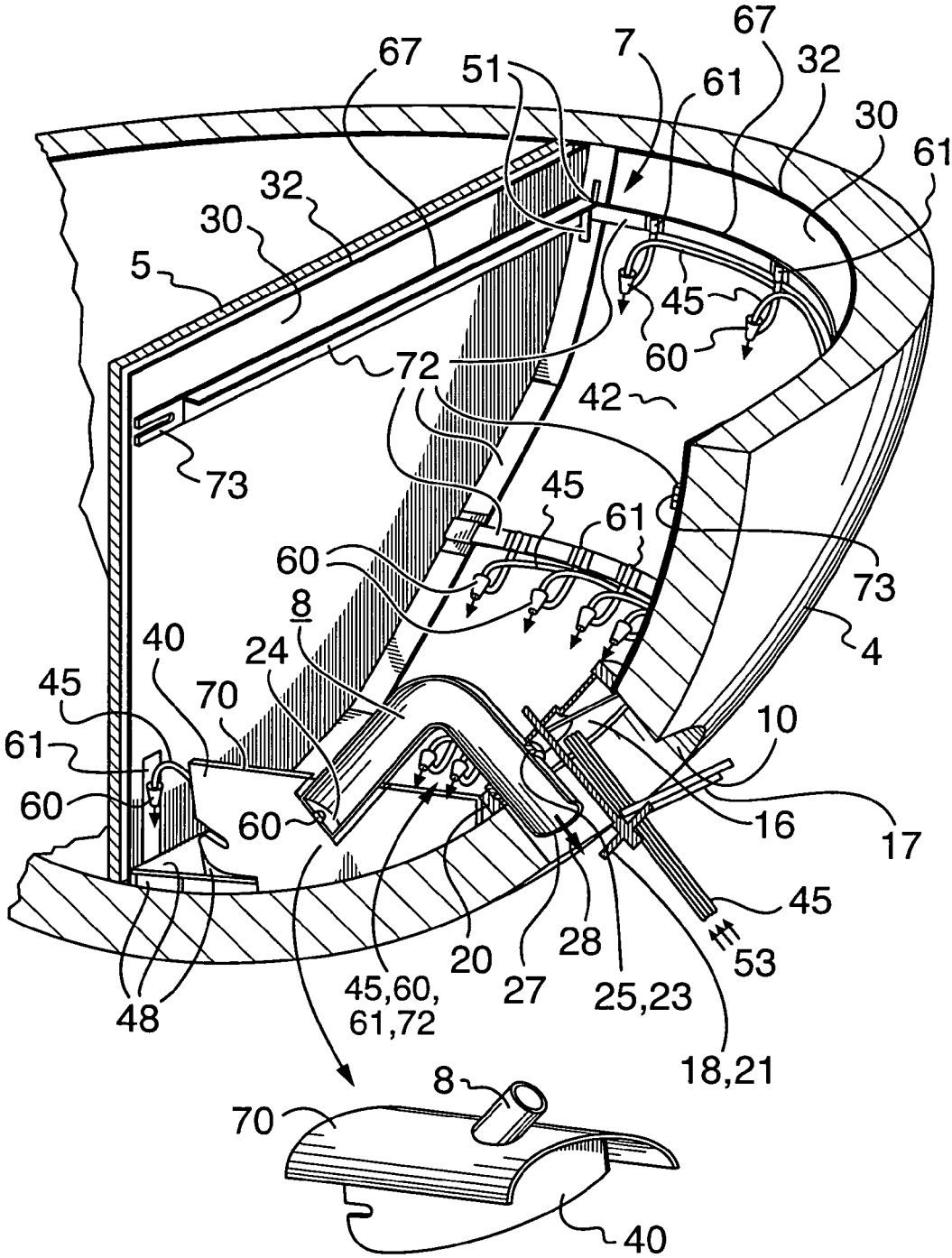
FIG. 2A is a perspective view in part section of the primary bowl showing another embodiment of the present invention.
Figure 2B:
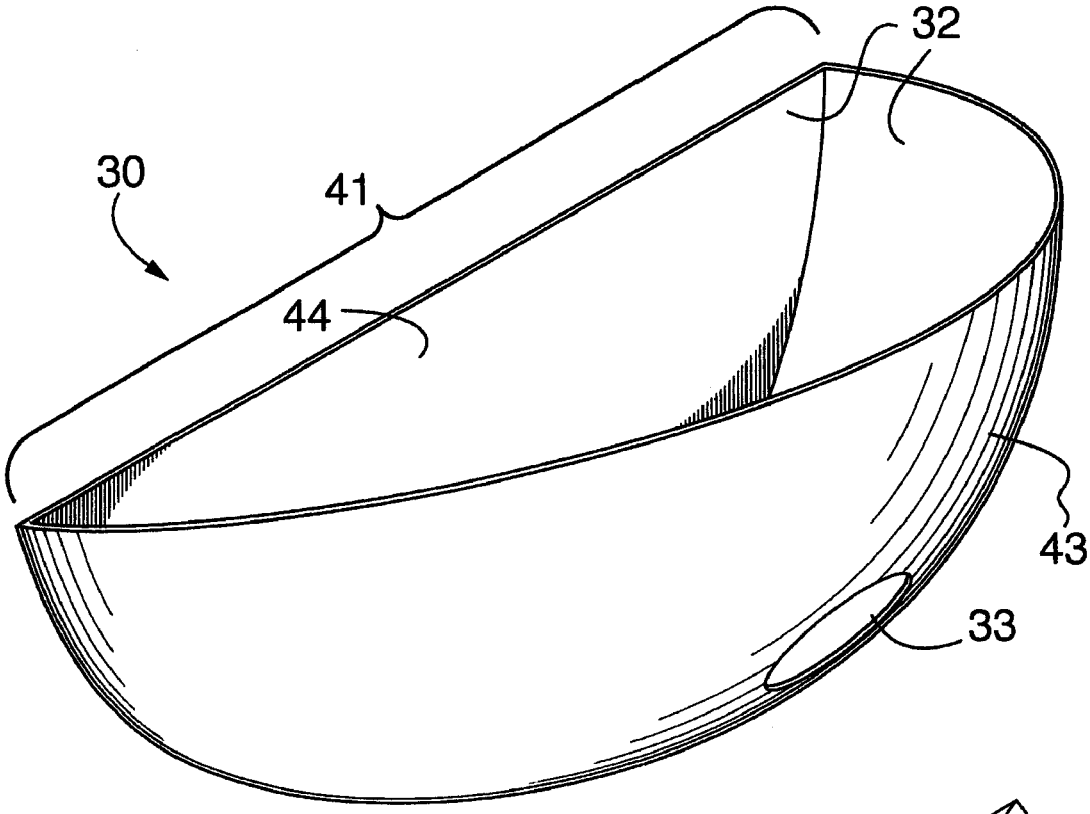
FIG. 2B is a schematic diagram showing a liner for use with the present invention.

The collection system of the present invention can include liner 30 on the inside surface of primary bowl 4. Liner 30 is a thin disposable polymeric membrane that conforms easily to the shape of primary bowl 4 and is anchored thereto along liner rim 32. As best shown in FIG. 2B, liner 30 comprises liner divider plate portion 44, liner nozzle portions 42, liner bowl portion 43, liner manway opening 33 and when deployed, forms at its upper rim 32, liner tubesheet opening 41.

As liner 30 is thin and quite flexible, when it is deployed into the steam generator cavity, it will be quit "floppy" around the rim, and gravity will tend to flop the liner inwards. Other areas of the liner are not affected this way because they lay against the bowl. If the rim were to flop inwards, media and debris would get behind the liner and contaminate the bowl area, which would defeat the purpose of the liner.

Fastener 31 holds the liner rim 32 in place. Fastener 31 can advantageously be a strip magnet, as the bowl and divider plate are composed of thick steel, making them suitable for securing with magnets. Alternatively a metal, plastic or fibreglass batten may be slid into liner rim 32, in which case the rim may incorporate pockets or loops to secure the batten in place. It is also advantageous to incorporate a soft foam material between the liner and the bowl (not shown), to take up any gaps that may form at the interface, to assure that it is properly sealed.

Figure 1B:
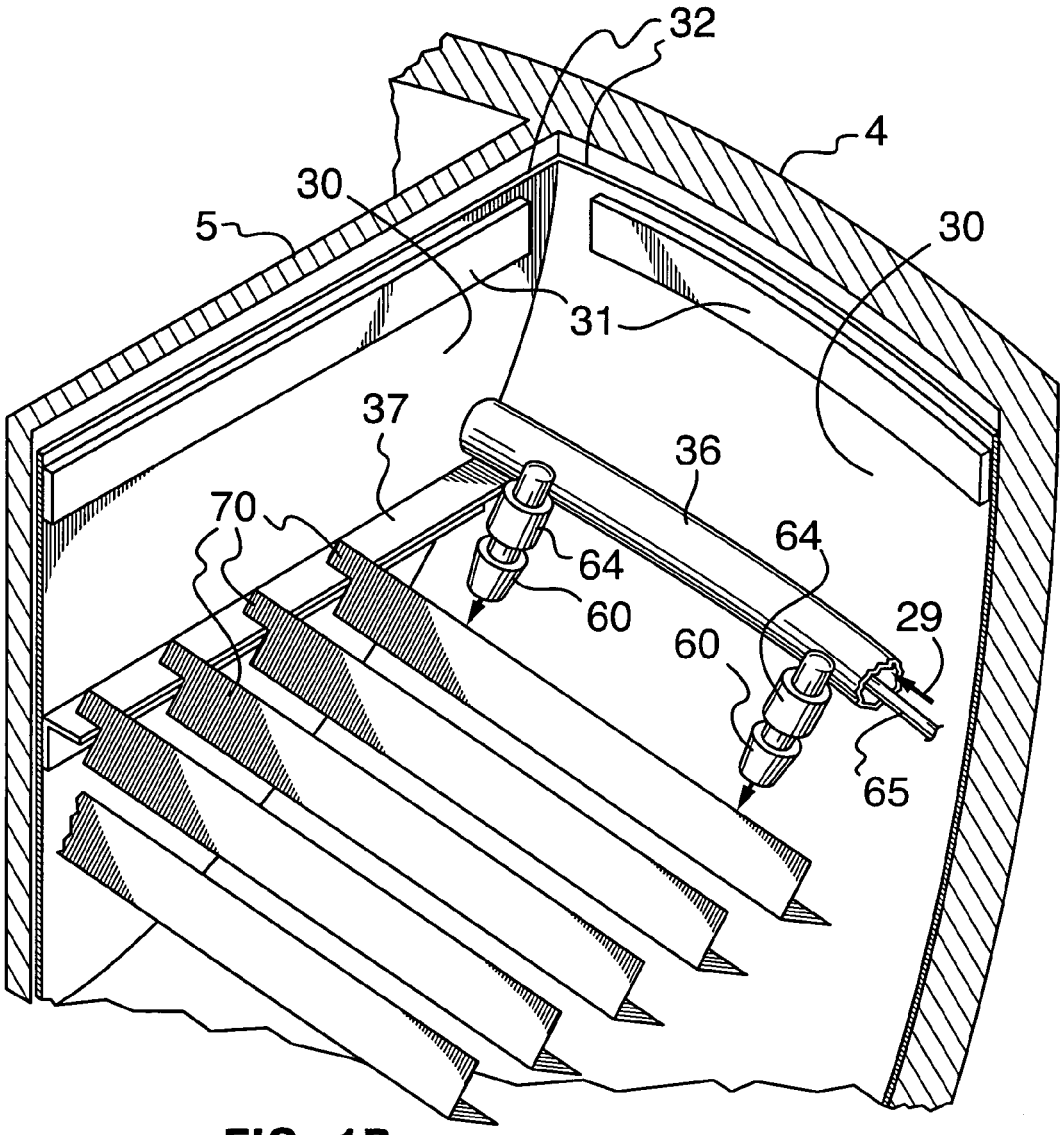
FIG. 1B is a perspective view in part section of the primary bowl showing the compressed air jets and breakers used in an embodiment of the present invention.
Figure 1C:
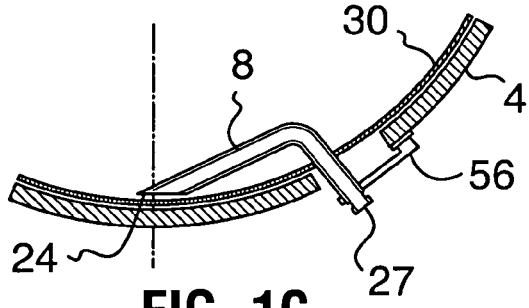
FIG. 1C is a cross-sectional view showing an alternative embodiment in which the manway is sealed by the liner.

In an alternative embodiment shown in FIG. 1C, manway cover 16 can be omitted, and suction line 8 can be secured to primary bowl 4 by mounting bracket 56. In this embodiment, liner 30 is extended to seal around suction line 8.

The collection system of the present invention may also include partition 40 which is positioned vertically in the middle of boiler cavity 2. Partition 40 can be fixed in position by a number of methods. For example, partition 40 can be fixed to the straight section of frame 37 positioned along the divider plate, the mid part of header 36 and the inlet end of suction line 8. As shown in FIG. 2A, the partition can be held by base 48 in primary bowl 4. In the alternative the partition may incorporate leg members (not shown) to render it self supporting. Partition 40 has a cutaway portion at its lower edge to accommodate suction line 8. Partition 40 may also be partial as shown in FIG. 2A, can be multiple in number and need not necessarily be positioned in the middle of cavity 2.

The collection system of the present invention may also include hopper 50 which is formed of a rigid semi-conical plate. Opening 52 is formed in hopper 50 at its lower end about suction inlet 24. Hopper 50 is supported at its upper and lower ends by contact with the inside surface of primary bowl 4 or with liner 30 if it is installed. Openings are also provided in hopper 50 to permit suction line 8 and air conduit 62 to pass there through, although they can be configured to pass over the top or under the bottom of hopper 50 to make installation easier. Electrically or pneumatically powered mechanical shakers 54 can be provided on the underside of hopper 50 to impart vibratory or shaking motion to hopper 50.

One or more air jet nozzles 60 can be disposed about the upper periphery of hopper 50 and positioned to direct a blast of air downwardly along the conical surface of hopper 50 toward suction inlet 24. Each air jet nozzle 60 is connected to solenoid valve 64 which taps into a compressed air source 29 from header 36. The compressed air is received through integrated conduit 35, manifold 11 and compressed air conduit 62. Electrical control lines 65 are routed through manifold 11, integrated conduit 35 and header 36. The air jets can be pulsed by electrically triggering solenoid actuated valves 64 at any desired repetition rate and duration. Manifold 11 is mounted to manway cover 16.

Referring now to FIG. 1B, details of the air jet nozzles 60 are shown. Air jet nozzles 60 and solenoid valves 64 are assembled together as a compact unit and are mounted directly to compressed air header 36 which holds a reservoir of compressed air. Header 36 is assembled from components and forms a rigid assembly which runs nearly 180° along the inside curvature of primary bowl 4. This arrangement limits line losses and maintains maximum pressure at nozzles 60 to ensure a powerful air jet action. Header 36 can be of a sufficiently robust design to permit several components to be supported from it including air jet nozzles 60 and solenoid valves 64, breakers 70 and partition(s) 40. Header 36 can rest against liner 30 and serves to push liner 30 against primary bowl 4 and divider plate 5.

A clean design is accomplished by carrying electrical control lines 65 inside integrated conduit 35 and header 36 to the respective solenoid valves 64. Thus, the number of wires and conduits exposed to the blast waste materials is decreased, making it easier to decontaminate upon uninstall. However, electrical control lines 65 can be routed outside of conduit 62 and header 36. While this configuration can simplify the design, lines that are exposed to the blast waste become radioactively contaminated and accordingly would probably need to be discarded to active waste at the end of the job.

Pulsed air jets are preferable to continuous air jets. Continuous air jets require substantial flow capacity from the compressed air source and the ingress of air into boiler cavity 2 would be great, and could cause waste to back stream up the steam generator tubes if the suction flow rate through suction line 8 was not able to keep up. Further, continuous air jets have no advantage over pulsed air jets for cleaning effectiveness. Air jet nozzles 60 are preferably pulsed on for a second or two, and more preferably, only one or a few nozzles 60 are turned on at a time, so that line losses in header 36, integrated conduit 35 and conduit 62 are negligible.

Breakers 70 may be disposed across boiler cavity 2 at a point intermediate tubesheet 6 and the bottom of the boiler cavity 2. Breakers 70 can be formed of an array of chevron or other suitably shaped elements, such as a polymeric mesh, to present a perforated barrier for dissipating the blast waste jets 80 from the steam generator tube(s) 7 being cleaned. As best seen in FIG. 1B, breakers 70 can be mounted to frame 37 along divider plate 5 and to header 36 along the curvature of the bowl (not shown).

A further alternative embodiment of the present invention is shown in FIG. 2A. In this embodiment, solenoid control valves 64 (not shown) are located outside of the boiler cavity 2 and individual compressed air conduits 45 are routed through manway cover 16 to nozzles 60.

With this configuration, the air jets are not as powerful because of line losses, but the design is easier to implement. In this embodiment, the conduits can be formed of plastic tubing which would become radioactively contaminated and thrown out to active waste at the end of the job. The penetration of air conduits 45 through manway cover 16 consists of pneumatic quick connectors on either side of cover 16.

Air jet nozzles 60 are arrayed in several layers along the bowl profile from the upper region of liner rim 32 down towards suction inlet 24. In the vicinity of suction inlet 24, several air jet nozzles 60 are strategically placed to direct waste materials to the suction inlet 24 and one nozzle 60 is disposed directly in suction inlet 24.

Internal frame 72 is used to hold liner 30 in place and support air jet nozzles 60 by means of mounts 61. The frame components are fabricated of carbon steel or other suitable rigid or semi-rigid materials such as plastic or fibreglass and are connected together by means of joint fingers 51. Base 48 is used to anchor the downwardly extending radial legs of frame 72 in place. Portions of frame 72 around rim 32 of liner 30 employ joint expanders 73 to permit frame 72 to be expanded to press liner 30 against primary bowl 4. Rim sealing gasket 67 formed of a soft foam strip of material can be applied between frame 72 and liner 30 so that any gaps to primary bowl 4 or divider plate 5 are sealed off. In an alternative embodiment, the internal frame 72 can be designed so that it is external to the liner (not shown), as this has the benefit of reducing the exposure of the frame to radioactive contamination.

In the embodiment show in FIG. 2A, partition 40 and breaker 70 (which can best be seen in the non-sectioned inset diagram in FIG. 2A) are considerably reduced in size to permit easy installation. It has been found that partitions and breakers of a relatively small size are relatively effective in retarding waste materials from streaming back up steam generator tubes 7.

In order to install the collection system of the present invention, the following procedure is followed. Access to boiler cavity 2 is gained by removing the manway cover. Liner 30 in either folded or rolled up condition is passed through manway 10 and is placed on the inside surface of primary bowl 4. Liner 30 is unfolded or unrolled and liner rim 32 is fastened to primary bowl 4 by fastener 31. Header 36, partition 40, hopper 50 and breakers 70 are each formed of sectional pieces which are individually passed through manway 10 and assembled together inside boiler cavity 2. Suction line 8 and manway cover 16 are then installed through manway opening 10.

Steam generator tubes 7 are cleaned using the collection system of the present invention in the following manner. Using a conventional manipulator system, a blasting head is connected to one (or more) tubes 7 to be cleaned on the cold leg side of the boiler cavity and the blasting media is forced through the tubes by compressed air. Blast waste jets 80 comprising blasting media and released magnetite deposits emerge from tubesheet 6 into the hot leg side of boiler cavity 2. Blast waste jets 80 strike breakers 70 (if fitted) which dissipates the energy of the waste particles and reduces the possibility of fine airborne particles re-entering steam generator tubes and contaminating the cleaned tubes and the blasting equipment on the cold leg side of the primary header. Partition 40 (if fitted) acts as a baffle to further reduce the possibility of fine airborne blast waste particles from re-entering the steam generator tubes.

A portion of the blast waste particles is removed from boiler cavity 2 while airborne by the powerful vacuuming action at suction inlet 24, and the balance of the blast waste particles are removed from the bottom of boiler cavity 2. Breakers 70 (if fitted) also serve to increase the amount of blast waste particles that drop onto the bottom surface of boiler cavity 2. The cutaway portion at the lower edge of partition 40 that accommodates suction line 8 allows blasting media and deposit material to be removed from either side of the partition.

Blast waste particles that settle on the bottom surface of boiler cavity 2 are drawn toward suction inlet 24 by gravity and airflow. The collected blasting media and deposit materials are conveyed out of boiler cavity 2 through suction line 8 and collected in a sacrificial container for permanent storage.

Suction inlet 24 is positioned in sufficiently close proximity to the bottom of boiler cavity 2 to effectively lift blast waste deposited on the surface of primary bowl 4 in the immediate vicinity of suction inlet 24, but not so close as to promote undue clogging around the suction inlet or unduly restrict the efficient vacuuming of airborne waste in boiler cavity 2. The distance between suction inlet 24 and the bottom surface of primary bowl 4 will depend in the amount of vacuum, the size of suction inlet 24 and the characteristics of the blast waste and can be adjusted accordingly to yield effective results.

Liner 30 can be used to cover the inlet and outlet primary side nozzles 3 to minimize contamination and shorten the clean up time after blasting. Primary nozzles 3 are a relatively large feature on a steam generator. During maintenance activities, bung 38 (usually a pneumatic inflated plug) is inserted in nozzle 3 from boiler cavity 2 to ensure that tools and debris do not fall in. In addition, nozzle cover 39 is installed over the opening of nozzle 3. Without liner 30, nozzle cover 39 must be sealed to the bowl to prevent waste particles from getting into primary nozzle 3. With liner 30, nozzle cover 39 can remain unsealed along its edges and the cover provides support to the liner to prevent it from sagging. Because the liner is supported by primary bowl 4 and nozzle cover 39, it need not have structural strength to support the weight of released deposits. Accordingly, it can be manufactured of a thin polymeric material that is easily installed in and removed from boiler cavity 2.

Hopper 50 can be used to promote the movement of settled blast waste particles toward suction inlet 24. The conical shape of hopper 50 provides for a smooth surface having a substantially greater slope than the central area at the bottom of boiler cavity 2 about suction inlet 24. The movement of debris toward suction inlet 24 can also be promoted by the use of electrically or pneumatically powered mechanical shakers 54 which impart a vibratory or shaking motion to hopper 50 and/or by the use of pulsed air jets from nozzles 60 which are disposed about the upper periphery of hopper 50 and positioned to direct a blast of air downwardly along the conical surface of hopper 50, thereby conveying debris toward suction inlet 24. As shown in FIG. 2A, pulsed air jets may also be employed along the bowl or liner (if hopper 50 is not used) at various locations to move waste materials, and at suction inlet 24 and about manway cover 12 to prevent the build-up of media and debris at these locations. In addition, a mechanical shaker (not shown) can also be positioned on suction inlet 24 to prevent clogging.

Upon uninstall, the manway cover, header 36, partition 40, hopper 50 and breakers 70 are removed. The liner is then vacuumed to remove any pockets of waste that remain, and the liner is folded up and removed from the bowl. Depending upon the condition of the liner, it can be reused in the next steam generator or disposed of in active waste.

Figure 3:
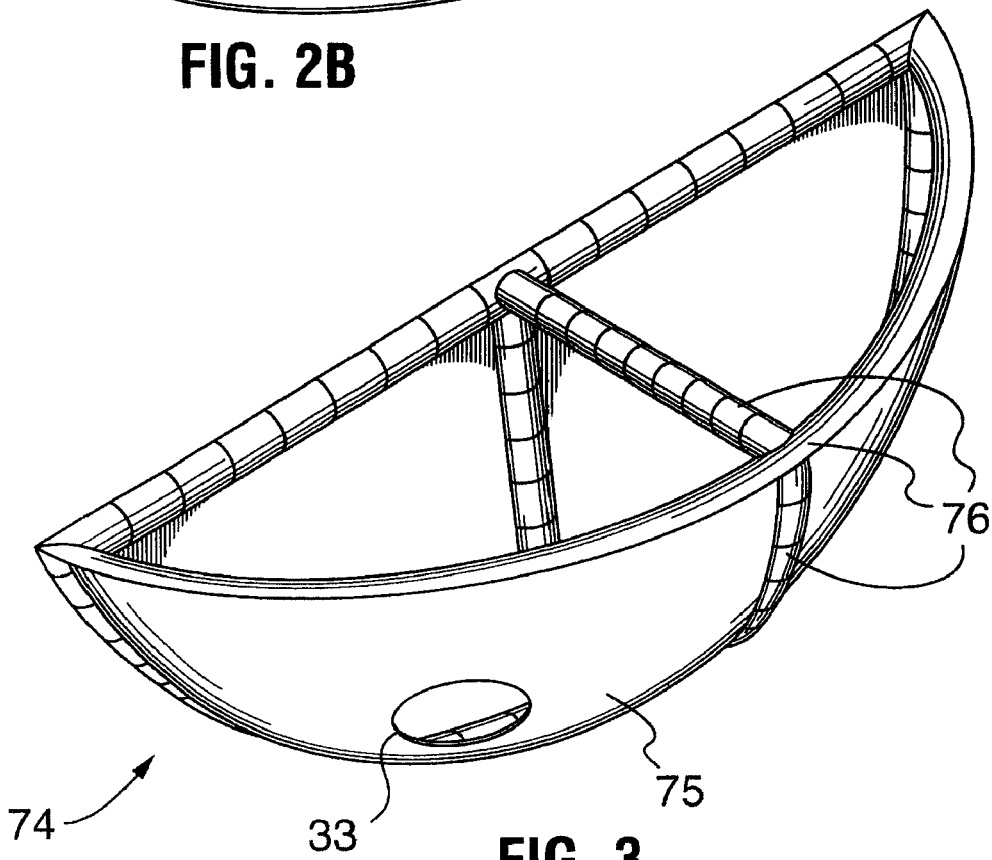
FIG. 3 is a schematic diagram showing an alternative liner construction having inflatable structures.

FIG. 3 shows a liner design in accordance with another embodiment of the present invention. In this embodiment, liner 74 incorporates inflatable structures 76 which when inflated, serve to conform liner 74 to the shape of the boiler cavity. Inflatable structures 76 include portions around the rim and additionally include bracing structures across the tubesheet opening and extending down from the rim along the liner wall 75. With this embodiment, an internal frame, magnets or other means of fastening the rim of the liner to the boiler cavity is not needed. Liner 74 can simply be deployed through manway opening 10 and inflated into position, reducing install and uninstall time and personnel boiler entries. After liner 74 is inflated in boiler cavity 2, the remaining components can be assembled, including partition(s) 40, breakers 70, nozzles 60, suction line 8 and manway cover 16. In a further alternative embodiment, the partition, breakers, nozzles, suction line, etc., can be integrated into inflatable liner 74 so that they are deployed into position when the liner is inflated. Inflatable liner 74 can be made from fibre reinforced polymeric materials, such as vulcanized rubber or other suitable materials. The side of liner 74 exposed to the waste blast can advantageously be lined with a layer of polymeric material such as rubber to resist abrasion from blasting. A soft foam may also be incorporated around the outside of the rim to seal against any irregularities that may exist with the steam generator features.

Figure 4A:
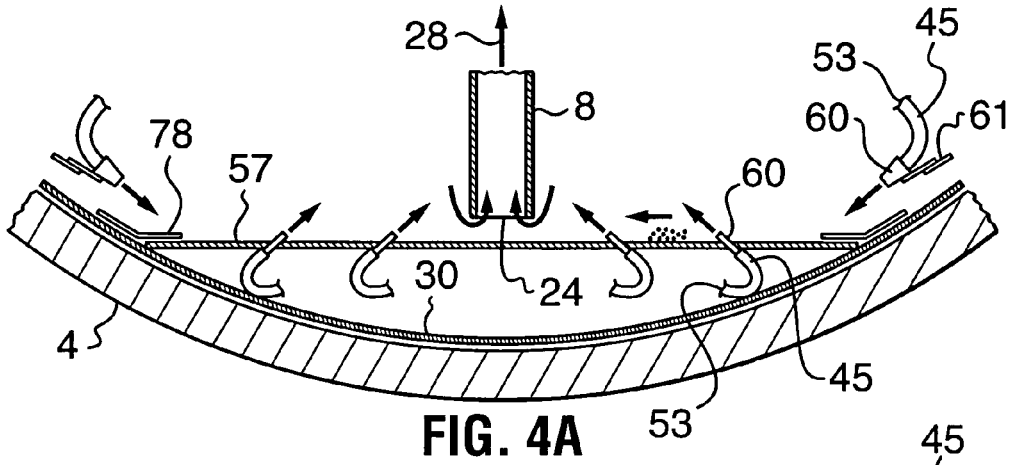
FIG. 4A is a cross-sectional view of the lower portion of the primary bowl showing an aerated base plate.
Figure 4B:
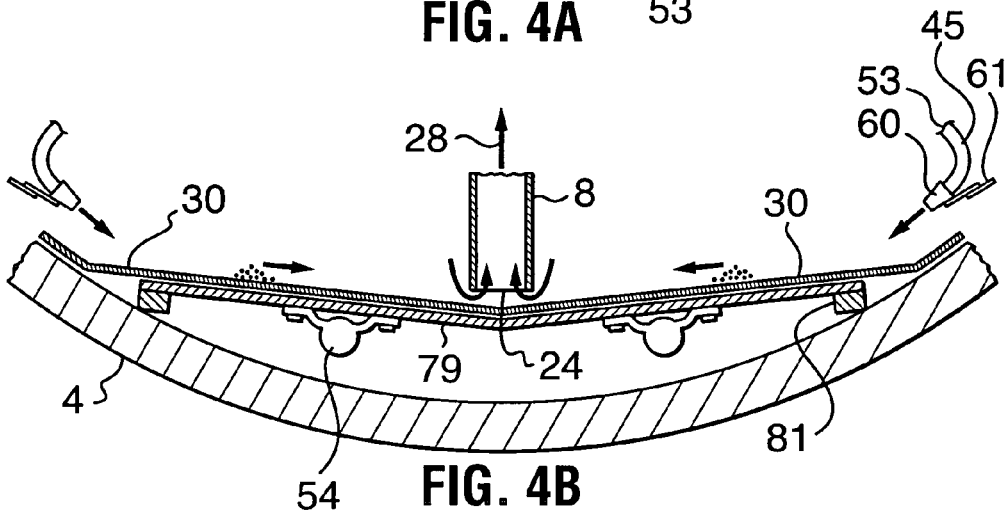
FIG. 4B is a cross-sectional view of the lower portion of the primary bowl showing a sloped base plate.
Figure 4C:
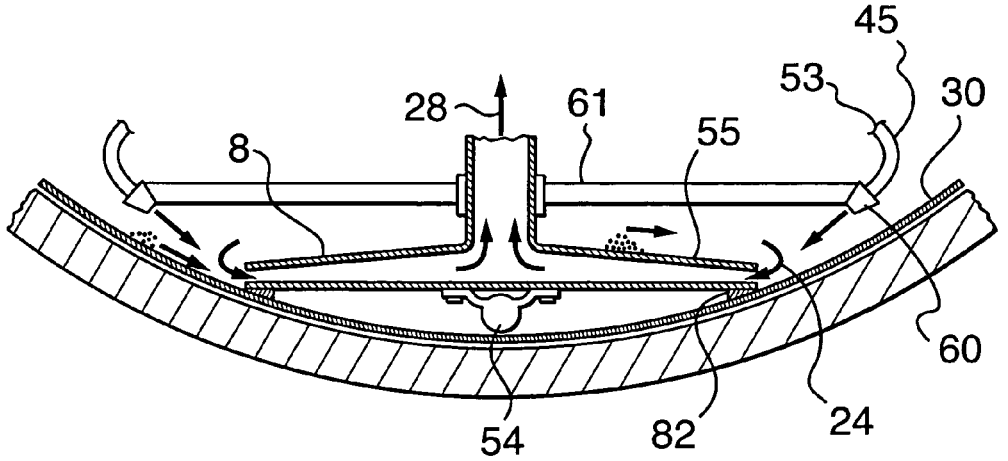
FIG. 4C is a cross-sectional view of the lower portion of the primary bowl showing an alternative suction line configuration.

FIGS. 4A through 4C show three alternative embodiments of the present invention and in particular, alternative designs at suction inlet 24. Because the base of the boiler is substantially horizontal, the relatively heavy blast shot media tends to pool or accumulate into piles in this area. As a result, the vacuuming action at suction inlet 24 may be insufficient to move waste beyond a few inches. While hopper 50 and air jet nozzles 60 can be employed as described above to address this problem, alternative solutions are also within the scope of the present invention.

As shown in FIG. 4A, aerated collecting surface 57 has embedded air jet nozzles 60 fixed to the underside. Nozzles 60 are connected to pulsed compressed air source 53 through air conduits (not shown) that are plumed back through manway cover 16. Nozzles 60 are angled to move waste towards suction inlet 24. Alternatively, the aerated collecting surface 57 can be simplified by employing angled perforations for nozzles and a common header underneath for supply of compressed air (not shown). As shown, additional air jets may still be required to move waste down from the periphery of primary bowl 4 to aerated collecting surface 57. Liner 30 runs under aerated collecting surface 57 and adhesive tape or other manually applied sealing element 78 can be used to seal the portion under aerated collecting surface 57 from the primary bowl cavity.

As shown in FIG. 4B, sloped plate 79 is disposed in the bottom of cavity 2 and is fitted with mechanical shaker(s) 54 to move waste towards the suction inlet 24. Liner 30 runs over sloped plate 79 so no additional sealing elements are required. The outer edges of sloped plate 79 are fitted with compliant 81 mounts made of an elastic material such as rubber to permit shaking movement of the plate.

As shown in FIG. 4C, suction line 8 can be terminated at its lower end in a suction chamber having radially extending upper and lower walls, with suction inlet 24 being formed in the peripheral edge of said suction chamber. Upper wall 55 is sloped downwardly and outwardly to suction inlet 24 to assist in waste egress. Mechanical shaker(s) 54 are fitted to the underside of suction line 8 and compliant isolation and sealing gasket 82 is fitted about the peripheral edge. Air jet nozzles 60 can be mounted to suction line 8 to aid in movement of debris toward suction inlet 24.

The collection system of the present invention offers a number of advantages over conventional prior art systems. In comparison to the manipulator collection system, the collection system of the present invention is significantly simpler and less operator intensive. In comparison to the conventional suction header, the collection system of the present invention is significantly easier to install, troubleshoot, uninstall, and clean up. The ease with which these tasks are carried out have important ramifications for personnel dose, because radiation levels are relatively high in the boiler cavity area and workers are permitted to spend limited time there, and for exposure of personnel to the waste deposits which are a hazardous radioactive contaminant.

These advantages are accomplished because unlike conventional suction header systems that use an external frame to secure the suction header in sealing engagement with the bowl or tubesheet, the present invention permits access between the suction inlet and inside the boiler cavity. This access permits devices such as breakers and partitions to be installed inside the cavity for minimizing back streaming contamination of cleaned tubes and blasting equipment and boiler cavity, thus minimizing cleanup efforts on the cold leg side. In addition, access to the inside of the boiler cavity allows a frame or other structure to be installed to achieve a better seal between the liner and primary bowl surface or tubesheet, thus minimizing contamination and cleanup efforts on the hot leg side.

Further, by utilizing the strength of the primary bowl to support liner 30, the liner can be made of thin and light material that can be easily set up and torn down. Sealing of the liner to the primary bowl surface or tubesheet is not compromised by the weight of the accumulated debris on the liner as the weight of the debris is supported by the primary bowl instead of the liner. The collection of deposited waste debris at suction inlet 24 is improved because suction line 8 is inverted and in close proximity to the floor of cavity 2. The inverted position of suction inlet 24 also tends to prevent the clogging experienced with prior art systems when a large volume or slug of debris is funnelled down into an upwardly directed suction point. The action of the downwardly directed suction inlet 24 of the present invention tends to lift debris in a more uniform and piece-meal fashion and thereby avoid clogging. Moreover, clogging is further reduced by the use of pulsed air jets and mechanical shakers which smooth the delivery of debris to the suction point by promoting release of accumulated deposits from the hopper and suction inlet.

The collection system of the present invention is simple to install, provides a more effective and efficient debris collection action, reduces the spread of radioactive material and reduces radiation doses to workers cause by back-streaming. The present invention also reduces the need to continuously adjust the manipulator system on the collection side.

While the present invention has been described with reference to a preferred embodiment, it will be appreciated by those skilled in the art that the invention may be practised otherwise than as specifically described herein without departing from the spirit and scope of the invention.

We claim:

1. In a heat exchanger having a plurality of heat exchanger tubes, the ends of which are received in a tubesheet disposed at the upper end of a chamber, said chamber having an access opening therein, a system for collecting blasting media and deposit debris exiting from said tubes into said chamber comprising:

a suction source, a suction line from said source passing through said access opening into said chamber, a removable liner disposed over the inside surface of said chamber for receiving deposited media and debris, means for sealing said access opening about said suction line, said suction line having a suction inlet effective to vacuum media and debris deposited on the bottom of said chamber.

2. The system of claim 1 wherein the liner is formed of a thin, flexible polymeric sheet.

3. The system of claim 2 further including fastening means for holding the upper rim of said liner to said inside surface of said chamber.

4. The system of claim 3 wherein the fastening means comprises magnetic strips.

5. The system of claim 2 wherein the liner comprises inflatable structures for supporting said liner in position over the inside surface of the chamber.

6. In a heat exchanger having a plurality of heat exchanger tubes, the ends of which are received in a tubesheet disposed at the upper end of a bowl shaped chamber, said chamber having an access opening therein, a system for collecting blasting media and deposit debris exiting from said tubes into said chamber comprising:

a suction source, a suction line from said source passing through said access opening into said chamber, at least one breaker disposed in said chamber intermediate said tubesheet and the bottom of said chamber for dissipating the energy of media and debris exiting said heat exchanger tubes, an access opening cover adapted for sealing engagement with said access opening about said suction line, said suction line having a suction inlet effective to vacuum media and debris deposited on the bottom of said chamber.

7. The system of claim 6 further comprising at least one air jet for directing a blast of compressed air along the inside surface of said chamber for moving deposited blasting media and debris towards said suction inlet.

8. The system of claim 6 further including at least one partition wall subdividing said chamber for restricting airborne media exiting a heat exchanger tube end on one side of the partition wall from entering a heat exchanger tube end on the other side of said partition wall.

9. The system of claim 8 wherein said at least one partition wall is formed in sections capable of being individually passed through said access opening and assembled inside said chamber.

10. The system of claim 9 wherein the lower edge of said at least one partition wall is disposed along the centre line of said suction inlet to permit media and debris on both sides of said partition to be vacuumed.

11. The system of claim 6 wherein said at least one breaker is formed in sections capable of being individually passed through said access opening and assembled inside said chamber.

12. The system of claim 6 further including a hopper having a downwardly and inwardly sloping peripheral wall, an upper opening at the top edge of said wall disposed below said tubesheet and a lower opening at the bottom edge of said wall about said suction inlet, said hopper being effective for receiving media and debris exiting said heat exchanger tubes of said chamber and for directing said received media and debris to said suction inlet.

13. The system of claim 12 wherein said hopper is formed in sections capable of being individually passed through said access opening and assembled inside said chamber.

14. The system of claim 12 further comprising a shaking device for imparting vibratory or shaking motion to said hopper.

15. The system of claim 12 further comprising at least one air jet for directing a blast of compressed air along said peripheral wall for moving deposited blasting media and debris on said peripheral wall towards said suction inlet.

16. The system of claim 15 wherein said blast of compressed air is pulsed.

17. The system of claim 16 wherein said blast of compressed air is pulsed by a solenoid actuated valve.

18. The system of claim 6 further comprising at least one air jet for directing a blast of compressed air toward said access opening cover.

19. The system of claim 6 further comprising at least one air jet for directing a blast of compressed air into said suction inlet.

20. The system of claim 6 further comprising a shaking device for imparting vibratory or shaking motion to said suction inlet.

21. The system of claim 6 wherein said suction inlet is downwardly directed and disposed centrally in the bottom of said chamber.

22. The system of claim 21 further comprising a plate disposed centrally in the bottom of said chamber and supported about its periphery by the inside surface of said chamber, the upper surface of said plate sloping downwardly and inwardly from its periphery to a point substantially directly below said suction inlet and a shaking device for imparting vibratory or shaking motion to said plate for moving deposited blasting media and debris on said plate towards said suction inlet.

23. The system of claim 21 further comprising a plate disposed centrally in the bottom of said chamber below said suction inlet and supported about its periphery by the inside surface of said chamber, a plurality of apertures formed through said plate, a plurality of air jets for directing blasts of compressed air through said apertures from below said plate for moving deposited blasting media and debris on said plate towards said suction inlet.

24. The system of claim 21 wherein said suction line is terminated at its lower end in a suction chamber having radially extending upper and lower walls, said suction inlet being formed in the peripheral edge of said suction chamber.

25. The system of claim 24 wherein the upper wall of said suction chamber is sloped downwardly and outwardly and further comprising a shaking device for imparting vibratory or shaking motion to said suction line.

26. In a heat exchanger having a plurality of heat exchanger tubes, the ends of which are received in a tubesheet disposed at the upper end of a chamber, said chamber having an access opening therein, a system for collecting blasting media and deposit debris exiting from said tubes into said chamber comprising:

a suction source, a suction line from said source passing through said access opening into said chamber, a removable liner disposed over the inside surface of said chamber for receiving deposited media and debris, an access opening cover adapted for sealing engagement with said access opening about said suction line, said suction line having a suction inlet effective to vacuum media and debris deposited on the bottom of said chamber.

27. The system of claim 26 wherein the liner is formed of a thin, flexible polymeric sheet.

28. The system of claim 27 further including fastening means for holding the upper rim of said liner to said inside surface of said chamber.

29. The system of claim 28 wherein the fastening means comprises magnetic strips.

30. The system of claim 27 wherein the liner comprises inflatable structures for supporting said liner in position over the inside surface of the chamber.

31. The system of claim 26 further comprising at least one air jet for directing a blast of compressed air along the inside surface of said liner for moving deposited blasting media and debris towards said suction inlet.

32. The system of claim 26 further including at least one partition wall subdividing said chamber for restricting airborne media exiting a heat exchanger tube end on one side of the partition wall from entering a heat exchanger tube end on the other side of said partition wall.

33. The system of claim 32 wherein said at least one partition wall is formed in sections capable of being individually passed through said access opening and assembled inside said chamber.

34. The system of claim 33 wherein the lower edge of said at least one partition wall is disposed along the centre line of said suction inlet to permit media and debris on both sides of said partition to be vacuumed.

35. The system of claim 26 further including at least one breaker disposed in said chamber intermediate said tubesheet and the bottom of said chamber for dissipating the energy of media and debris exiting said heat exchanger tubes.

36. The system of claim 35 wherein said at least one breaker is formed in sections capable of being individually passed through said access opening and assembled inside said chamber.

37. The system of claim 26 further including a hopper having a downwardly and inwardly sloping peripheral wall, an upper opening at the top edge of said wall disposed below said tubesheet and a lower opening at the bottom edge of said wall about said suction inlet, said hopper being effective for receiving media and debris exiting said heat exchanger tubes of said chamber and for directing said received media and debris to said suction inlet.

38. The system of claim 37 wherein said hopper is formed in sections capable of being individually passed through said access opening and assembled inside said chamber.

39. The system of claim 38 further comprising a shaking device for imparting vibratory or shaking motion to said hopper.

40. The system of claim 37 further comprising at least one air jet for directing a blast of compressed air along said peripheral wall for moving deposited blasting media and debris on said peripheral wall towards said suction inlet.

41. The system of claim 40 wherein said blast of compressed air is pulsed.

42. The system of claim 41 wherein said blast of compressed air is pulsed by a solenoid actuated valve.

43. The system of claim 26 further comprising at least one air jet for directing a blast of compressed air toward said access opening cover.

44. The system of claim 26 further comprising at least one air jet for directing a blast of compressed air into said suction inlet.

45. The system of claim 26 further comprising a shaking device for imparting vibratory or shaking motion to said suction inlet.

46. The system of claim 26 wherein said suction inlet is downwardly directed and disposed centrally in the bottom of said chamber.

47. The system of claim 46 further comprising a plate disposed centrally in the bottom of said chamber and supported about its periphery by the inside surface of said chamber, the upper surface of said plate sloping downwardly and inwardly from its periphery to a point substantially directly below said suction inlet and a shaking device for imparting vibratory or shaking motion to said plate for moving deposited media and debris on said plate towards said suction inlet.

48. The system of claim 46 further comprising a plate disposed centrally in the bottom of said chamber below said suction inlet and supported about its periphery by the inside surface of said chamber, a plurality of apertures formed through said plate, a plurality of air jets for directing blasts of compressed air through said apertures from below said plate for moving deposited blasting media and debris on said plate towards said suction inlet.

49. The system of claim 46 wherein said suction line is terminated at its lower end in a suction chamber having radially extending upper and lower walls, said suction inlet being formed in the peripheral edge of said suction chamber.

50. The system of claim 49 wherein the upper wall of said suction chamber is sloped downwardly and outwardly and further comprising a shaking device for imparting vibratory or shaking motion to said suction line.

51. The system of claim 26 wherein said access opening cover comprises a peripheral resilient sealing element for engagement with the inside of said chamber and an outer bracket for engagement with the outside of said chamber and means for drawing said cover and bracket toward one another.

52. The system of claim 3 wherein the fastening means comprises a frame disposed on the inside surface of said liner for securing said liner over the inside surface of said chamber.

53. The system of claim 3 wherein the fastening means comprises a frame disposed between said liner and the inside surface of said chamber for securing said liner over the inside surface of said chamber.

54. The system of claim 28 wherein the fastening means comprises a frame disposed on the inside surface of said liner for securing said liner over the inside surface of said chamber.

55. The system of claim 28 wherein the fastening means comprises a frame disposed between said liner and the inside surface of said chamber for securing said liner over the inside surface of said chamber.

* * * * *